US009874218B2

(12) United States Patent
Shafer et al.

(10) Patent No.: US 9,874,218 B2
(45) Date of Patent: Jan. 23, 2018

(54) MINIMAL-ACOUSTIC-IMPACT INLET COOLING FLOW

(75) Inventors: Timothy C. Shafer, Alpine, CA (US); Samantha Elizabeth Stoneman, Poway, CA (US); Frank Cantor, Cypress, CA (US)

(73) Assignee: HAMILTON SUNDSTRAND CORPORATION, Windsor Locks, CT (US)

( * ) Notice: Subject to any disclaimer, the term of this patent is extended or adjusted under 35 U.S.C. 154(b) by 1917 days.

(21) Appl. No.: 13/188,831

(22) Filed: Jul. 22, 2011

(65) Prior Publication Data

US 2013/0022461 A1 Jan. 24, 2013

(51) Int. Cl.

| | |
|---|---|
| ***F04D 29/68*** | (2006.01) |
| ***F04D 29/16*** | (2006.01) |
| ***F04D 29/28*** | (2006.01) |

(52) U.S. Cl.

CPC ..... *F04D 29/162* (2013.01); *F04D 29/281* (2013.01); *F04D 29/685* (2013.01)

(58) Field of Classification Search

USPC ..... 415/1, 173.1, 119, 92, 52.1, 58.2, 58.3, 415/58.4; 416/185, 179, 181, 182, 189

See application file for complete search history.

(56) References Cited

U.S. PATENT DOCUMENTS

| | | | | |
|---|---|---|---|---|
| 3,107,627 | A * | 10/1963 | Clarke et al. | 416/182 |
| 4,926,630 | A | 5/1990 | Shekleton | |
| 5,033,263 | A | 7/1991 | Shekleton et al. | |
| 5,085,039 | A | 2/1992 | Shekleton | |
| 5,207,054 | A | 5/1993 | Rodgers et al. | |
| 5,399,064 | A * | 3/1995 | Church et al. | 415/58.3 |
| 5,502,689 | A | 3/1996 | Peterson et al. | |
| 6,139,257 | A | 10/2000 | Proctor et al. | |
| 6,409,471 | B1 | 6/2002 | Stow | |
| 6,702,550 | B2 | 3/2004 | Darkins, Jr. et al. | |
| 7,322,202 | B2 | 1/2008 | Zywiak et al. | |
| 7,400,501 | B2 * | 7/2008 | Bartell et al. | 361/695 |
| 7,628,583 | B2 * | 12/2009 | Roberts et al. | 415/208.3 |
| 2003/0049120 | A1 * | 3/2003 | Behrendt et al. | 415/151 |
| 2003/0133790 | A1 | 7/2003 | Darkins, Jr. et al. | |
| 2004/0062639 | A1 | 4/2004 | Glynn et al. | |
| 2005/0118019 | A1 | 6/2005 | Roberts et al. | |
| 2007/0230114 | A1 | 10/2007 | Bartell et al. | |

FOREIGN PATENT DOCUMENTS

| | | |
|---|---|---|
| JP | 03-021312 | 1/1991 |
| JP | 2001165091 | 12/1999 |
| WO | 9845601 | 10/1998 |

* cited by examiner

*Primary Examiner* — Craig Kim
*Assistant Examiner* — Michael Sehn
(74) *Attorney, Agent, or Firm* — Carlson, Gaskey & Olds, P.C.

(57) ABSTRACT

An impeller shroud for a mechanical system has a hyperboloid shape with a rim at the air-inlet end. The face of the inlet rim is perpendicular to the flow direction. A plurality of slots through which air is allowed to pass is disposed symmetrically about the rim. A plurality of solid areas extends along the circumference of the rim between the adjacent slots. The ratio of the sum of the plurality of slots in degrees and the sum of the solid areas in degrees disposed about the rim is between 3:1 and 11:1.

19 Claims, 3 Drawing Sheets

MINIMAL-ACOUSTIC-IMPACT INLET COOLING FLOW

BACKGROUND

Inlet shrouds may be used to direct fluid (typically air) flow to an impeller wheel. The impeller wheel may be driven by an electro-mechanical motor or by an external system (shaft-driven). The purpose of the aforementioned machine may be to provide compressed air to an air conditioning system or the like. Impeller inlet shrouds may shape the flow to the impeller wheel.

SUMMARY

According to an embodiment shown herein, an impeller shroud for a mechanical system has a hyperboloid shape with a rim at the air-inlet end. The face of the inlet rim is perpendicular to the flow direction. A plurality of slots through which air is allowed to pass is disposed symmetrically about the rim. A plurality of solid areas extends along the circumference of the rim between the adjacent slots. The ratio of the sum of the plurality of slots in degrees and the sum of the solid areas in degrees disposed about the rim is between 3:1 and 11:1.

According to a further embodiment shown herein, an impeller shroud for a mechanical system has a hyperboloid shape with a rim at the air-inlet end. The face of the inlet rim is perpendicular to the flow direction. Fifteen slots through which air is allowed to pass are disposed symmetrically about the rim. Fifteen solid areas extend along the rim circumference between the adjacent slots. The ratio between the sum of the fifteen slots in degrees and the sum of the fifteen solid areas in degrees disposed about the rim is between 3:1 and 11:1.

According to a further embodiment shown herein, a method of using a shroud for a mechanical system includes the steps of providing an impeller shroud having a hyperboloid shape having an inlet rim, providing a plurality of slots disposed symmetrically about the rim, and providing a plurality of solid areas, each solid area extending along the circumference of the rim between adjacent slots and wherein a ratio between a sum of the fifteen slots in degrees and a sum of the fifteen solid areas in degrees disposed about the rim is between 3:1 and 11:1; and providing air through the slots to enter a flow entering the shroud.

These and other features of the present disclosure can be best understood from the following specification and drawings, the following of which is a brief description.

DETAILED DESCRIPTION

Figure 1:
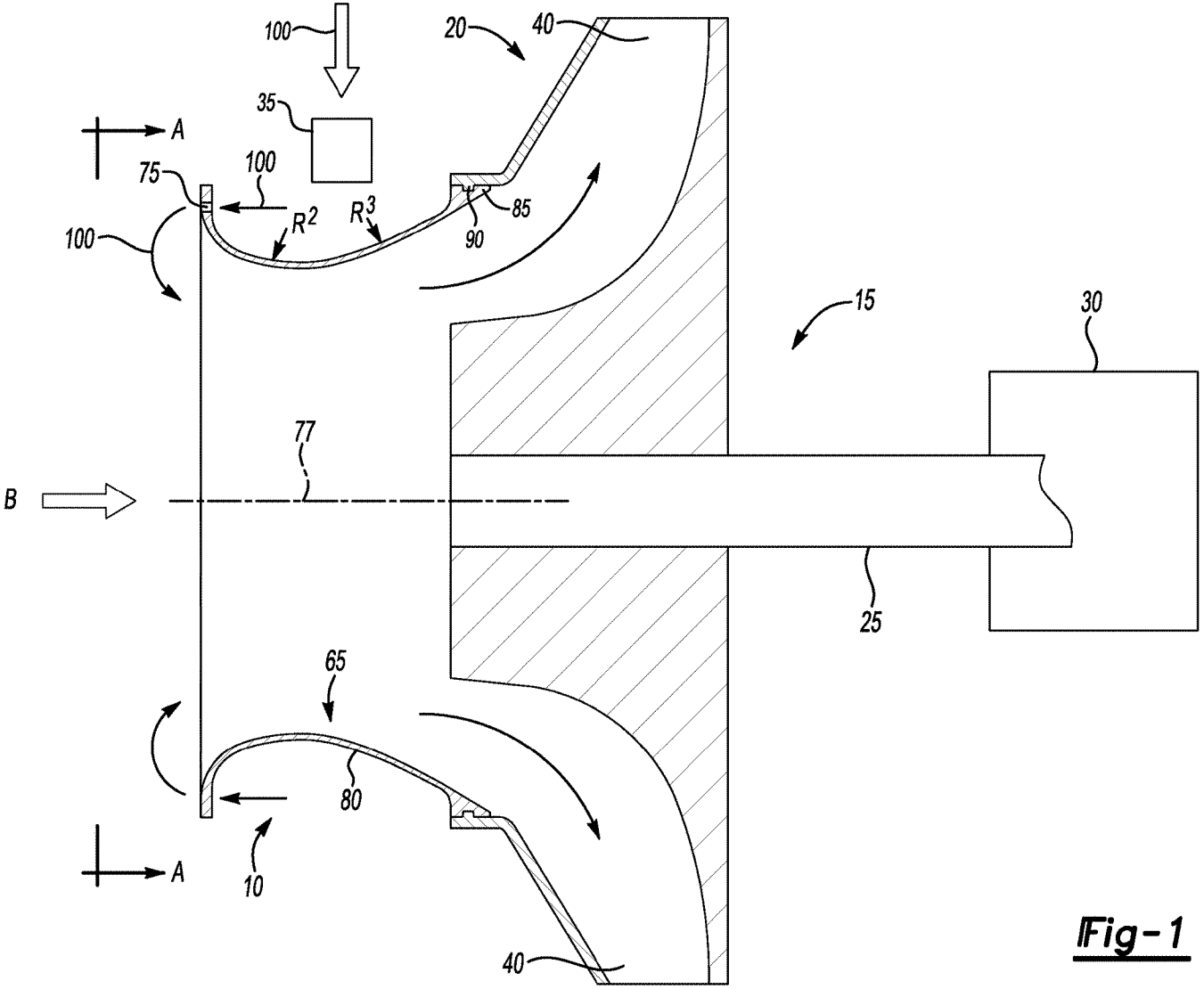
FIG. 1 is a side perspective view of an embodiment of an impeller shroud as described herein.
Figure 1A:
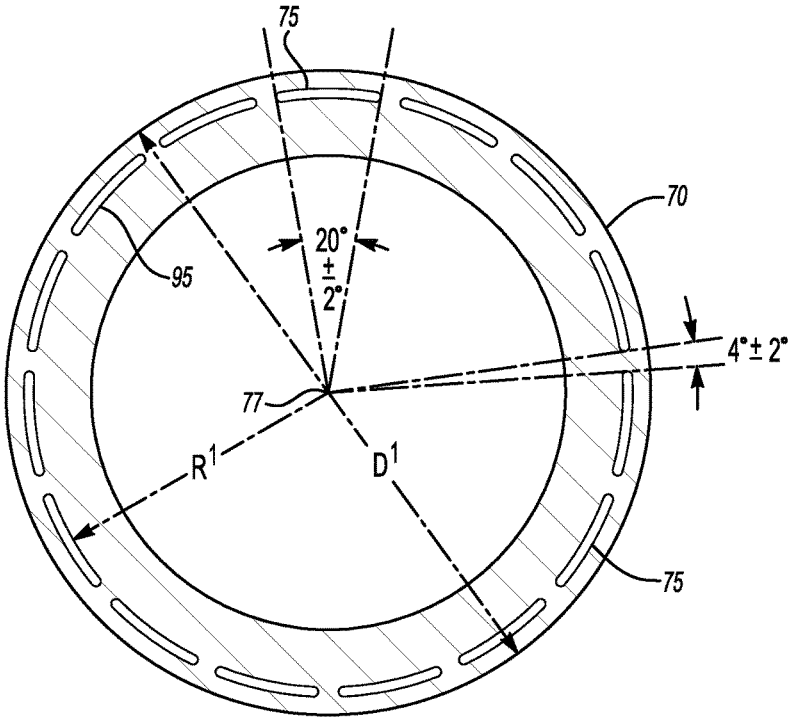
FIG. 1A is a front view of the impeller shroud of FIG. 1 taken along the line A-A.

Referring now to FIGS. 1 and 1A, a shroud 10, which may be an inlet shroud for an impeller, is described. The inlet shroud 10 directs air B to an impeller wheel 15. The impeller wheel 15 is connected to a shaft 25 which may be externally driven, or the rotating component of an electric motor system 30 or other accessory. An electronics component 35 is mounted outside of the inlet shroud 10 and needs cooling. Though an electronics box 35 is shown, other components that need cooling are also contemplated herein. A gap 40 is defined to be located downstream of the impeller 15. A portion of air B exits the main air stream downstream of the impeller 15 and passes through the electronics component 35.

The inlet shroud 10 has a body 65 having a hyperboloid shape and has an inlet rim 70 extending transversely therefrom including 15 arced slots 75 symmetrically distributed about the inlet rim 70. Each of the arced slots 75 is defined by a 20°±2° arc extending from an axis 77 passing through the inlet shroud 10, the impeller wheel 15 and the exhaust 20 of the system. A solid portion 80 between each arced slot 75 is defined by an arc of 4°±2° . Each of the arced slots 75 extends from a radius $R^1$ of about 4 inches (or 10.2 centimeters) and is about 0.125 inches (or 0.318 centimeters) deep. The diameter D of the inlet rim 70 is approximately 8.74 inches (or 22.2 centimeters). The arced slots 75 form about 270° to 330° of the circumference of the inlet rim 70 and the solid portion forms 60°±30° of the circle. The ratio of open arced slot 75 to the solid portion 80 is therefore between 3:1 and 11:1. A particular ratio includes, among others, 5:1. Stated in another way the area encompassed by the slots is approximately 2.7 square inches (or 17.4 square centimeters). The area of the prior art, as will be discussed infra, is approximately 0.5 square inches (or 3.2 square centimeters). Though 15 arced slots 75 are described herein, other numbers of inlet slots are contemplated herein providing the other numbers conform to the methods herein.

The body 65 has a contoured portion 80 defined by a second radius $R^2$ of 0.50±0.06 inches (or 1.27±0.38 centimeters) which extends from and blends into the inlet rim 70 towards and blending into a third radius $R^3$ of 0.25 inches±0.06 inches (or 0.64±0.15 centimeters). The third radius $R^3$ blends into flange 85. The flange 85 has a groove 90 which may be the seat for a sealing ring (not shown). The arced radius $R^2$ blends into the inner edge 95 of each arced slot 75.

In operation, cooling air 100 bathes the electronics component 35 to cool it and then passes through the arced slots 75 into the main air stream B.

Figure 2:
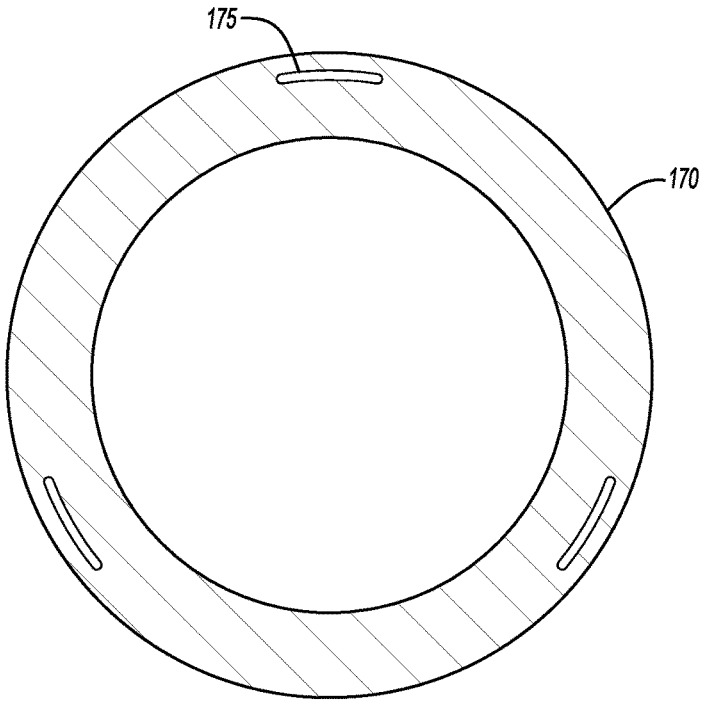
Fig-2 PRIOR ART
FIG. 2 is a front view of a prior art impeller shroud.

As shown in the prior art in FIG. 2, rim 170 has three arced inlet slots 175. The Applicants have discovered that three inlet slots known in the prior art provide a spike in sound pressure levels. The new shroud model has the same geometry as the existing shroud; however, the arced slots 75 have been expanded to provide an area of approximately 2.7 square inches (or 17.4 square centimeters) as opposed to 0.5 square inches (or 3.2 square centimeters) achieved by the prior art.

Figure 3:
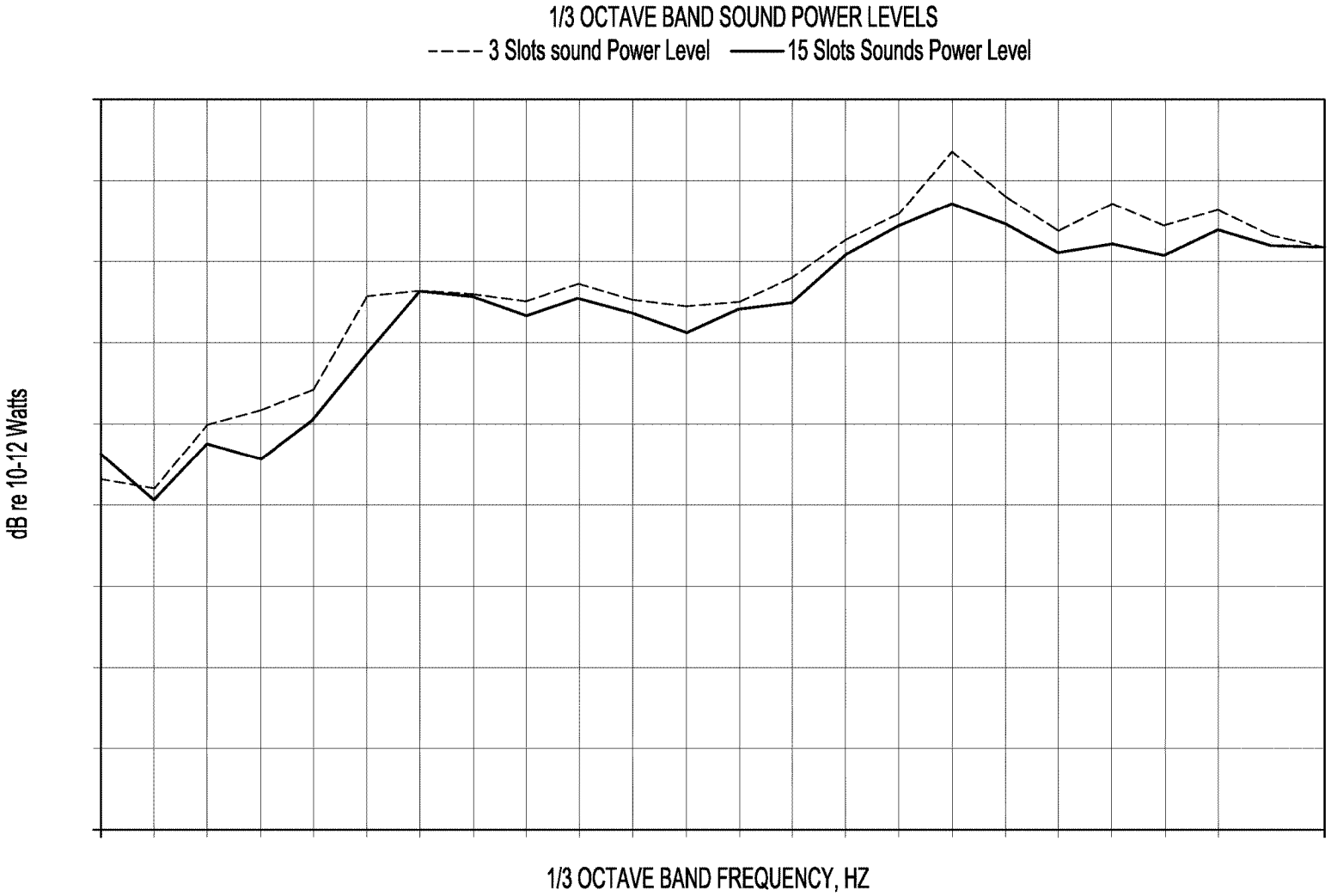
FIG. 3 is a graphic view of a relationship of decibels to frequency between the shroud of FIG. 1 and the prior art.

Analysis of the 15 slot inlet shroud 10 showed that the increased discharge area in a more symmetrical distribution of the slots will reduce noise at blade passing frequencies and will reduce turbulence in the inlet. Acoustic tests have been run and consistently show that the new inlet shroud 10 reduces the sound pressure level by approximately 15 decibels at a first order frequency and 4 decibels at a second order of frequency. Full octave band and one-third octave band analyses (See FIG. 3) show that noise levels in every octave band are lowered for the 15 slot inlet shroud 10.

Although preferred embodiments have been disclosed, a worker of ordinary skill in this art would recognize that certain modifications would come within the scope of this disclosure. For that reason, the following claims should be studied to determine the true scope and content of this disclosure.

What is claimed is:

1. A shroud for a mechanical system said shroud comprising:

a hyperboloid shape having an inlet rim perpendicular to an air flow;

a plurality of slots, disposed symmetrically about said rim, through which air passes; and a plurality of solid areas, each solid area extending along a circumference of said rim between adjacent slots and wherein a ratio between a sum of said plurality of slots in degrees and a sum of said solid areas in degrees disposed about said rim is between 3:1 and 11:1.

2. The shroud of claim 1 wherein said ratio is 5:1.

3. The shroud of claim 1 wherein said sum of said plurality of slots in area is about 17.4 square centimeters.

4. The shroud of claim 1 wherein a component to cool is mounted outside of said hyperboloid shape.

5. The shroud of claim 4 wherein said component is an electronic component.

6. The shroud of claim 1 wherein said plurality of slots lowers a sound pressure level of said shroud.

7. The shroud of claim 6 wherein said plurality of slots lowers a sound pressure level of said shroud by about 15 decibels at a first order frequency.

8. The shroud of claim 6 wherein said plurality of slots lowers a sound pressure level of said shroud by about 4 decibels at a second order frequency.

9. The shroud of claim 1 wherein said plurality of slots is fifteen slots.

10. The shroud of claim 1 wherein said shroud is used with an impeller.

11. The shroud of claim 1 wherein an inlet to each of the plurality of slots is in fluid communication with ambient air located radially outward from a radially outer most surface of the shroud.

12. An impeller shroud for a mechanical system said shroud comprising:

a hyperboloid shape having an inlet rim perpendicular to an air flow;

a plurality of slots disposed symmetrically about said rim, through which air passes; and fifteen solid areas each, extending along a circumference of said rim between adjacent slots and wherein a ratio between a sum of said plurality of slots in degrees and a sum of said fifteen solid areas in degrees disposed about said rim is between 3:1 and 11:1.

13. The impeller shroud of claim 12 wherein said ratio is 5:1.

14. The impeller shroud of claim 12 wherein said plurality of slots lowers a sound pressure level of said shroud by about 15 decibels at a first order frequency.

15. The impeller shroud of claim 12 wherein said plurality of slots lowers a sound pressure level of said shroud by about 4 decibels at a second order frequency.

16. A method of using a shroud for a mechanical system, said method comprising:

providing a shroud having a hyperboloid shape having an inlet rim;

providing a plurality of slots disposed symmetrically about said rim; and providing fifteen solid areas, each extending along a circumference of said rim between adjacent slots and wherein a ratio between a sum of said plurality of slots in degrees and a sum of said fifteen solid areas in degrees disposed about said rim is between 3:1 and 11:1;

providing air through said plurality of slots to enter a flow entering said shroud; and drawing ambient air through the plurality of slots at a lower pressure than within the shroud.

17. The method of claim 16 wherein said plurality of slots lowers a sound pressure level of said shroud.

18. The method of claim 17 wherein said plurality of slots lowers said sound pressure level of said shroud by about 15 decibels at a first order frequency.

19. The method of claim 17 wherein said plurality of slots lowers said sound pressure level of said shroud by about 4 decibels at a second order frequency.

* * * * *